United States Patent [19]

Rutherford

[11] Patent Number: 4,987,724

[45] Date of Patent: Jan. 29, 1991

[54] METHOD OF PACKAGING CHRISTMAS LIGHTING

[76] Inventor: Cathy O. Rutherford, 4201 Conowingo Rd., Darlington, Md. 21034

[21] Appl. No.: 424,995

[22] Filed: Oct. 23, 1989

[51] Int. Cl.[5] ..... B65B 5/04; B65B 13/02; B65B 67/04; B23P 19/02

[52] U.S. Cl. ..... 53/399; 53/390; 53/430; 53/469; 29/235

[58] Field of Search ..... 29/235, 234; 53/241, 53/390, 399, 397, 430, 441, 459, 467, 469, 530, 585, 567, 592

[56] References Cited

U.S. PATENT DOCUMENTS

| | | | |
|---|---|---|---|
| 1,721,155 | 7/1929 | Johnson | 29/234 |
| 2,194,451 | 3/1940 | Soubier | 53/415 X |
| 2,224,504 | 12/1940 | Milmoe | 53/480 X |
| 2,522,788 | 9/1950 | Ingraham | 53/459 |
| 2,720,055 | 10/1955 | Morris | 53/530 X |
| 2,741,884 | 4/1956 | Best | 53/241 X |
| 4,280,314 | 7/1981 | Stuck | 53/390 X |
| 4,324,087 | 4/1982 | Mitchell et al. | 53/241 |

FOREIGN PATENT DOCUMENTS

| | | | |
|---|---|---|---|
| 1244932 | 9/1960 | France | 53/390 |
| 587067 | 1/1959 | Italy | 53/390 |
| 1197786 | 7/1970 | United Kingdom | 53/530 |

*Primary Examiner*—Robert L. Spruill
*Assistant Examiner*—Beth Bianca
*Attorney, Agent, or Firm*—Robert Halper

[57] ABSTRACT

A method for packaging electric wiring by using a grasping tool to assist in ensleeving the wiring in a plastic sleeve. Subsequent to ensleeving the grasping tool is disengaged. The sleeve with the enclosed wiring is folded over to form a neat compact package which is secured and ready for storage.

11 Claims, 1 Drawing Sheet

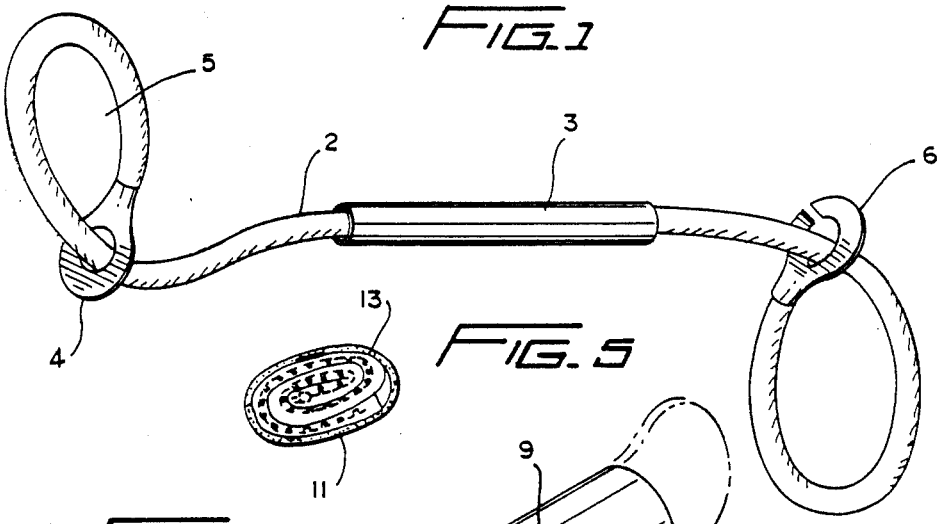
FIG. 1
FIG. 5
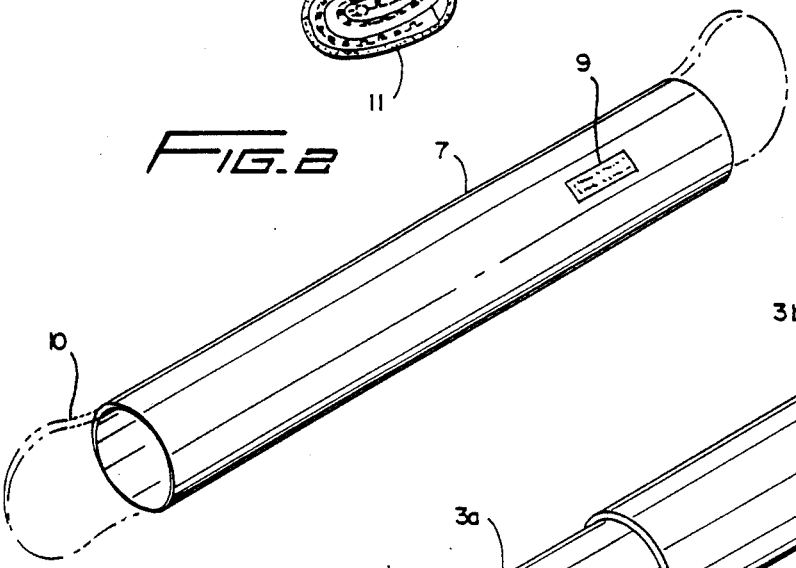
FIG. 2
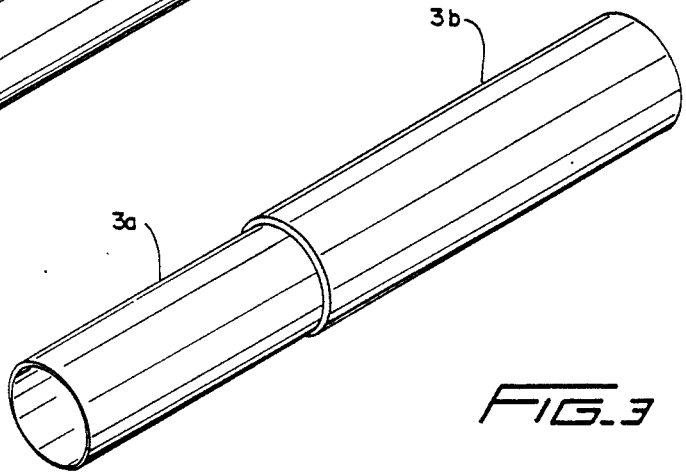
FIG. 3
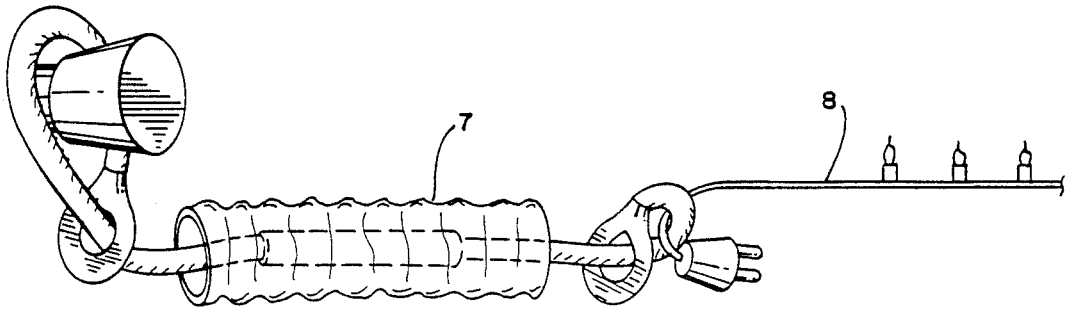
FIG. 4

METHOD OF PACKAGING CHRISTMAS LIGHTING

INTRODUCTION

This invention relates to packaging and unpackaging of electric wiring, particularly of the type used in Christmas decorations.

BACKGROUND OF THE INVENTION

Every year throughout the U.S. and many other countries as well many of us go thru the ritual of preparing for Christmas. Lighting has long been recognized as a prime feature in decorating the household and often the exterior of the house including the shrubbery as well. On consultation with a countless number of people it was not surprising to discover that after the holidays it was generally the custom to gather up all the wiring and deposit is haphazardly on a shelf or in a box and forget about it until the following year. As the holidays approached and one sought to prepare for decorating, more often that not what one discovered was a hopelessly tangled mess which required precious time to sort out.

A search of the prior art tuned up the following patents. Re No. 29,214, 652,901, 1,405,357, 1,949,298, 2,194,451, 3,562,998, 4,178,735. Only Re No. 29,214 appears to be concerned with packaging electric wiring. However the main purpose here is to preassemble wiring to certain building specifications. Moreover the wiring is simply placed in an envelope and additionally there are required individual packages for branch cables. There is not need or use of a special tool for packaging or unpackaging as is required in this invention.

BRIEF SUMMARY OF THE INVENTION

My invention is directed to obviate the aforementioned difficulties resulting from unplanned handling of some of the accouterments of Christmas. By a simple expedient it solves the problem by packaging the wiring in a longitudinal plastic sleeve which is then folded over and secured to make a neat, compact package. All that is needed to accomplish this feat is a cord with attaching devices at each end and a collar placed proximate the center of the cord to facilitate gripping the cord. Preferably the attaching devices can be made in the form of adjustable loops. To package the wiring one loop is placed around an upstanding immobile fixture such as a door knob and tightened. The other loop is passed thru an elongated sleeve laid out horizontally on a planar surface such as a floor by grabbing the collar and pulling the sleeve over the cord toward the immobile fixture until the cord and its other loop is outside of the sleeve. Since the sleeve is so much longer than the cord, this operation can be facilitated by bunching the sleeve. Once the cord is outside of the bunched sleeve, the other loop on the cord is placed around the wire plug and tightened. To complete packaging of the wire the sleeve is extended and pulled over the wire in a reverse direction from the immobile fixture until the wire is completely within the sleeve. Alternatively instead of pulling the sleeve over the wire the cord part adjacent the immobile fixture can be pulled until the attached wire is enclosed by the sleeve. Once the wire is ensleeved, the loops are disengaged and the sleeve is folded over to make a neat package, and secured as a by a rubber band, If desired flaps could be placed on the ends of the sleeve. These flaps could be tucked into the sleeve openings to make a closure once the wire has been packaged. To remove the wire from the package the procedure is merely reversed. The rubber band is removed, the sleeve unfolded and with the tool attached as described above, the sleeve is pulled away from the wire of the wire is pulled away from the sleeve and the tool disengaged from the wire and the fixture.

For a better understanding of the invention the specification that follows described specific details of the process of the invention.

BRIEF DESCRIPTION OF THE DRAWING

FIG. 1 is a perspective view of the pulling tool including the collar.

FIG. 2 is a front view of the sleeve in tis extended position.

FIG. 3 is another embodiment of the collar of the tool shown in FIG. 1.

FIG. 4 is a view showing how the tool is used to package the wiring.

FIG. 5 shows the packaged wiring.

DETAILED DESCRIPTION

FIG. 1 illustrates a supple serpentine-like pulling tool which comprises a cord 2 which is partially covered by a loose fitting collar 3 made of plastic and centrally located on the cord. THe collar aids in gripping and pulling the cord thru the sleeve. At one end of the cord is affixed a metal clasp 4. A loop 5 is formed in the cord by passing the free end of the cord thru the clasp. Then the collar is slipped over the free end of the cord an positioned approximately in the center thereof. The free end of the cord is stisted to make another loop and a clasp 6 having split sections is affixed to the cord and opened wide enough to go over the cord at the loop end. The split sections are then aligned and closed by a pliers. The pulling tool is about eight feet long and the collar about a foot and a half long. Instead of making the collar in one piece, the same can be subdivided into a male collar **3*a* and a female collar 3*b* wherein the male collar telescopically fits into the female collar. By subdividing the collar, packaging of the tool would be facilitated. A plastic sleeve 7 of polyethylene o r the like, shown in FIG. 2 is about 3–4 inches in diameter considerably greater than the tool or wiring that traverses the sleeve and can vary in length depending on the wiring to be packaged, but is generally about 16 feet in length. FIG. 4 is illustrative of packaging an electric wire 8 wherein one loop of the pulling tool is slipped over the male end of the wire, tightened and the other end of the tool is passed thru the sleeve which is bunched to shorten it, whereupon the other loop is slipped over the door knob and tightened. When this operation is done, the sleeve is extended to its natural length and pulled away from the fixture and over the wiring until the wiring is completely covered. The loops are then disengaged and the sleeve is folded over to form a neat package 11 which is secured, for example, by a rubber band 13. Before encircling by a rubber band, self sticking labels 9 may be applied to the sleeve exterior to indicate where wiring is to be used, for example on the Christmas trees. This package can then be safely doted until further use. If desired flaps 10** can be attached to the sleeve at the ends and form a closure for the wiring by tucking the flaps into the openings.

This invention while simple is very practical and is time efficient. While the invention has been illustrated for packaging Christmas light wiring, it obviously can be used to package any type of wiring material including extension cords and the like.

I claim:

1. The method of packaging electric wiring oriented horizontally in extended condition, comprising placing a flexible longitudinal sleeve of considerably greater diameter than said wiring between an upstanding immobile fixture and adjacent to and in the path of said electric wiring, attaching one end of a supple serpentine like grasping tool to said immobile fixture, bunching said sleeve to shorten it, and pulling the tool through the sleeve so that a second end of said tool is adjacent the electric wiring, attaching said second end to one end of said electric wiring, extending and pulling the sleeve over said electric wiring until said wiring is completely ensleeved, disengaging the ends of said tool from said fixture and said wiring, and folding and securing said sleeve to make a neat compact package.

2. The method of claim 1 wherein said wiring is of the type used for Christmas lighting.

3. The method of claim 1 wherein said fixture is attached by looping one end of said tool over said fixture and said wiring is attached by looping said second end of said tool over said one end of said wiring and after said attaching the loops are tightened.

4. The method of claim 3 wherein said immobile fixture is a door knob.

5. The method of claim 1 wherein said flexible material is a transparent plastic such as polyethylene.

6. The method of claim 1 wherein the grasping tool is a cord considerably shorter than said sleeve said cord having loops at each end and a plastic collar loosely attached to the cored intermediate its ends and said cord traverses the sleeve by bunching the sleeve, manually gripping one end of the collar and pulling the sleeve in the direction of said fixture until at least the other end of said cord has exited.

7. The method of claim 6 wherein the grasping tool collar is subdivided into two parts which are telescopically joined.

8. The method of claim 1 wherein the package is secured by encircling with a rubber band and a self-sticking lable is applied to the exterior of the package.

9. The method of claim 1 wherein the ends of said sleeve have flaps attached thereto and said sleeve ends are closed by tucking said flaps therein.

10. The method of packaging and removal of electric wiring comprising extending said wiring having a plug at one end horizontally on a planar surface, placing adjacent said plug and in alignment therewith one end of a longitudinal plastic sleeve of considerably greater diameter than said wiring, placing the other end of said sleeve in the vicinity of a door knob, looping one end of a cord having a centrally located loosely fitting plastic collar over said knob and tightening the same, placing said other end of the cord adjacent said other end of said sleeve, bunching the sleeve, gripping one end of said collar and pulling the sleeve in the direction of the knob until said other end of the cord has exited the sleeve, looping said other cord end over the plug and tightening the same, extending the sleeve by pulling the sleeve in a direction away from the knob until said wiring has been completely ensleeve, disengaging said ends of said cord from said knob and said wiring, holding said sleeve to form a neat package, securing said package by encircling with a rubber band and placing a self sticking lable on the package, removing electric wiring from said packaging comprising unsecuring and unfolding the package until it is completely extended, bringing to bear adjacent one end of said unfolded package a cord having loops at both ends and a gripping collar at the center of the cord, passing one end of the wiring thru one of said loops, and attaching the loop at the other end of the cord to an upstanding immobile fixture, tightening said loops and pulling said sleeve in a direction away from the immobile fixture until said wiring has been extracted from the package.

11. The method of claim 10 wherein the ends of said sleeve have flaps and closing said sleeve ends by tucking said flaps therein.

* * * * *